US010855038B1

(12) United States Patent
Horning et al.

(10) Patent No.: US 10,855,038 B1
(45) Date of Patent: Dec. 1, 2020

(54) HYBRID ELECTRICAL CONNECTOR

(71) Applicant: TE CONNECTIVITY SERVICES GMBH, Schaffhausen (CH)

(72) Inventors: Michael James Horning, Landisville, PA (US); Christopher William Blackburn, Bothell, WA (US); Robert Neil Mulfinger, York Haven, PA (US); Jason M'Cheyne Reisinger, Carlisle, PA (US)

(73) Assignee: TE CONNECTIVITY SERVICES GmbH, Schaffhausen (CH)

( * ) Notice: Subject to any disclaimer, the term of this patent is extended or adjusted under 35 U.S.C. 154(b) by 0 days.

(21) Appl. No.: 16/694,747

(22) Filed: Nov. 25, 2019

(51) Int. Cl.

| | |
|---|---|
| ***H01R 13/648*** | (2006.01) |
| ***H01R 27/02*** | (2006.01) |
| ***H01R 13/631*** | (2006.01) |
| ***H01R 13/6582*** | (2011.01) |
| ***H01R 13/502*** | (2006.01) |
| ***H01R 13/6585*** | (2011.01) |

(52) U.S. Cl.
CPC ..... *H01R 27/02* (2013.01); *H01R 13/502* (2013.01); *H01R 13/631* (2013.01); *H01R 13/6582* (2013.01); *H01R 13/6585* (2013.01)

(58) Field of Classification Search
CPC .... H01R 27/02; H01R 13/502; H01R 13/631; H01R 13/6582; H01R 13/6585
USPC ..... 439/607.01–607.05
See application file for complete search history.

(56) References Cited

U.S. PATENT DOCUMENTS

| | | | | |
|---|---|---|---|---|
| 7,727,001 | B2 | 6/2010 | Percherke et al. | |
| 8,801,474 | B2 * | 8/2014 | Rong | H01R 13/113 439/737 |
| 8,845,347 | B2 * | 9/2014 | Karl | B60R 11/02 439/157 |
| 9,401,558 | B1 * | 7/2016 | Yu | H01R 4/02 |

* cited by examiner

*Primary Examiner* — Khiem M Nguyen

(57) ABSTRACT

A hybrid electrical connector includes a housing, a first power module, a negative power module, and a signal module. The housing has a guide module having guide surfaces for guiding mating with a mating electrical connector. The guide module is approximately centered between first and second sides and remote from the first and second sides. The first power module includes first power contacts and the negative power module includes negative power contacts. The signal module includes signal contacts and ground shields providing electrical shielding for the signal contacts. The signal module is located between the first power module and the negative power module.

20 Claims, 5 Drawing Sheets

HYBRID ELECTRICAL CONNECTOR

BACKGROUND OF THE INVENTION

The subject matter herein relates generally to electrical connectors.

Electrical connectors are used to connect electrical components within an electronic device or system and transmit electrical power or signals therebetween. Frequently, the electrical connectors are mounted to a circuit board or another part of the device. Because the amount of available surface area on the circuit board or within the device is limited, the size of the electrical connectors should be minimized. Some known systems require transmission of both power and data between the components. Typically, the systems include separate power connectors and separate signal connectors that are arranged adjacent each other as a connector assembly. Additionally, the systems typically include separate guide modules to guide mating of the connector(s) forming additional components of the connector assembly. However, providing multiple connectors and guide modules at a mating interface causes the connector assembly to occupy a large surface area. Furthermore, providing the guide features along the outside of the mating interface increases the overall footprint of the connector assembly.

A need remains for an electrical connector having a reduced footprint.

BRIEF DESCRIPTION OF THE INVENTION

In one embodiment, a hybrid electrical connector is provided including a housing, a first power module, a second power module, and a signal module. The housing extends between a front and a rear. The housing has a first side and a second side opposite the first side. The housing has a top and a bottom opposite the top. The housing has a guide module having guide surfaces for guiding mating with a mating electrical connector. The guide module is approximately centered between the first side and the second side remote from the first side and remote from the second side. The first power module includes first power contacts coupled to the housing proximate to the first side each having a terminating end and a mating end configured to be mated to first power contacts of the mating electrical connector. The second power module includes second power contacts coupled to the housing proximate to the second side each having a terminating end and a mating end configured to be mated to second power contacts of the mating electrical connector. The signal module includes signal contacts and ground shields providing electrical shielding for the signal contacts. Each signal contact has a terminating end and a mating end configured to be mated to signal contacts of the mating electrical connector. The signal module is located between the first power module and the second power module.

In another embodiment, a hybrid electrical connector is provided including a housing, a positive power module, a negative power module, and a signal module. The housing extends between a front and a rear. The housing has a top and a bottom opposite the top. The housing has a first side and a second side opposite the first side. The housing includes a first connector at the first side, a second connector at the second side, and a center connector between the first connector and the second connector. The center connector includes a guide module having a primary guide surface for guiding mating with a mating electrical connector in a primary direction and a secondary guide surface for guiding mating with the mating electrical connector in a secondary direction perpendicular to the primary direction. The positive power module is provided at the first connector. The positive power module includes positive power contacts coupled to the housing proximate to the first side each having a terminating end and a mating end configured to be mated to positive power contacts of the mating electrical connector. The negative power module is provided at the second connector. The negative power module includes negative power contacts coupled to the housing proximate to the second side each having a terminating end and a mating end configured to be mated to negative power contacts of the mating electrical connector. The signal module is provided at the center connector. The signal module includes signal contacts and ground shields providing electrical shielding for the signal contacts. Each signal contact has a terminating end and a mating end configured to be mated to signal contacts of the mating electrical connector. The signal module is located between the positive power module and the negative power module.

In another embodiment, an electrical connector system is provided including a first hybrid electrical connector and a second hybrid electrical connector. The first hybrid electrical connector includes a first housing, a first positive power module, a first negative power module and a first signal module between the first positive power module and the first negative power module. The first housing extends between a front and a rear. The first housing has opposite first and second sides. The first positive power module includes first positive power contacts coupled to the first housing proximate to the first side of the first housing. The first negative power module includes first negative power contacts coupled to the first housing proximate to the second side of the first housing. The first signal module includes first signal contacts and first ground shields providing electrical shielding for the first signal contacts. The first signal module includes a first guide module having first guide surfaces. The first guide module is located between the first positive power module and the first negative power module. The second hybrid electrical connector includes a second housing, a second positive power module, a second negative power module and a second signal module between the second positive power module and the second negative power module. The second housing extends between a front and a rear. The second housing has opposite first and second sides. The second positive power module includes second positive power contacts coupled to the second housing proximate to the first side of the second housing. The second positive power contacts are mated to first positive power contacts. The second negative power module includes second negative power contacts coupled to the second housing proximate to the second side of the second housing. The second negative power contacts are mated to the first negative power contacts. The second signal module includes second signal contacts and second ground shields providing electrical shielding for the second signal contacts. The second signal contact are mated to the first signal contact and the second ground shields being mated to the first ground shields. The second signal module includes a second guide module having second guide surfaces. The second guide module is located between the second positive power module and the second negative power module. The second guide surfaces interface with the first guide surfaces of the first guide module to align the second signal module with the first signal module prior to mating the second signal contact and the first signal contact. The second guide surfaces interface with the first guide surfaces of the first guide module to align the second positive power module with the first positive power module prior to mating the second positive power contact and the first positive power contact. The second guide surfaces interface with the first guide surfaces of the first guide module to align the second negative power module with the first negative power module prior to mating the second negative power contact and the first negative power contact.

DETAILED DESCRIPTION OF THE INVENTION

Figure 1:
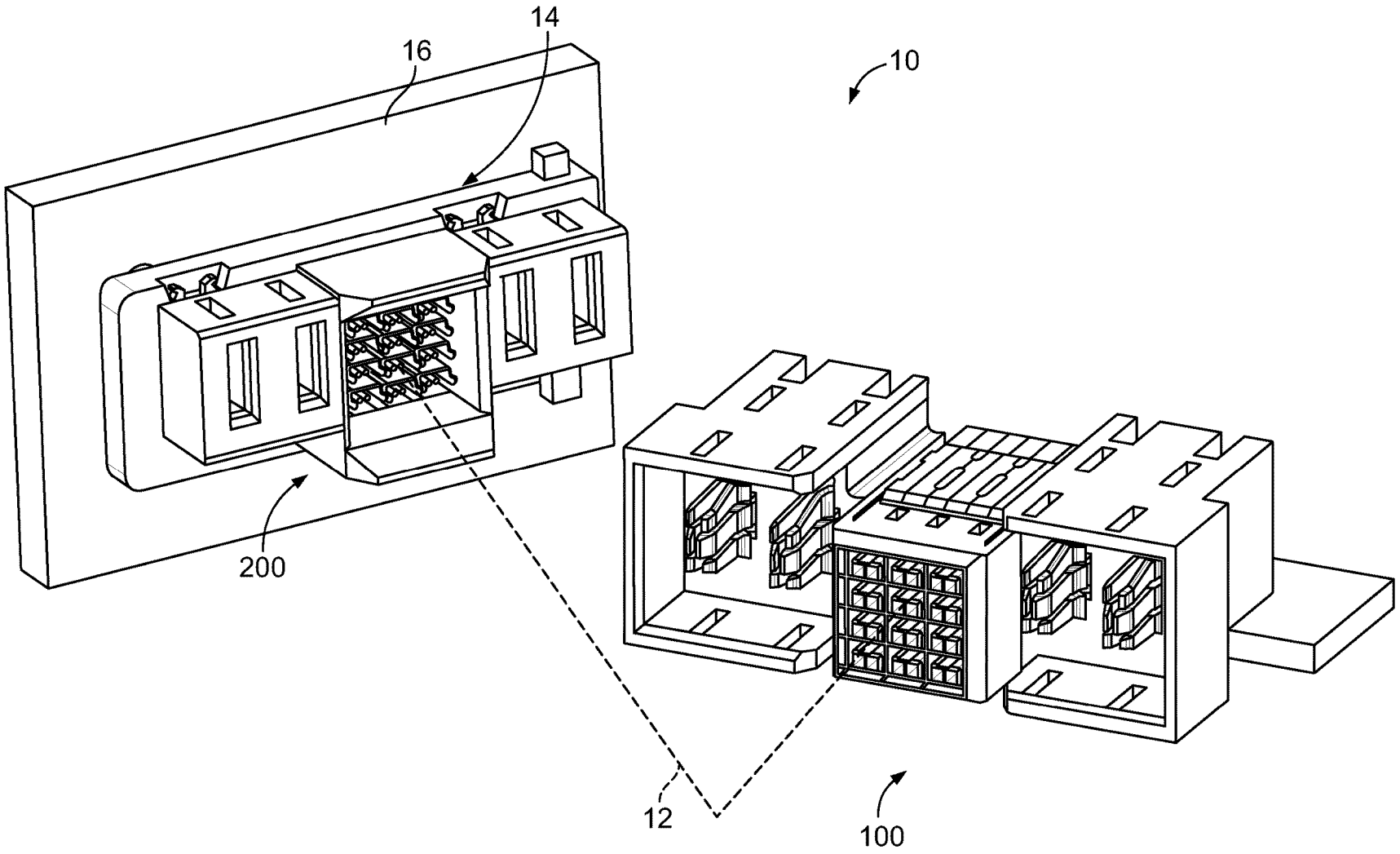
FIG. 1 illustrates an electrical connector system in accordance with an exemplary embodiment including first and second hybrid electrical connectors.

FIG. 1 illustrates an electrical connector system 10 in accordance with an exemplary embodiment. The electrical connector system 10 includes a first hybrid electrical connector 100 and a second hybrid electrical connector 200. The hybrid electrical connectors 100, 200 are configured to be mated along a mating axis 12. The first hybrid electrical connector 100 includes a power interface and a signal interface for transmitting power and data. The second hybrid electrical connector 200 includes a power interface and a signal interface for transmitting power and data.

In the illustrated embodiment, the first hybrid electrical connector 100 is a board mounted connector terminated to a circuit board 20. In alternative embodiments, the first hybrid electrical connector 100 may be a cable connector terminated to corresponding cables, such as power cables and data cables. In the illustrated embodiment, the second hybrid electrical connector 200 is a cable connector terminated to corresponding cables, such as power cables and data cables. However, in alternative embodiments, the second hybrid electrical connector 200 may be a board mounted connector terminated to a circuit board. In the illustrated embodiment, the second hybrid electrical connector 200 is a panel connector mounted in a panel opening 14 of a panel 16.

Figure 2:
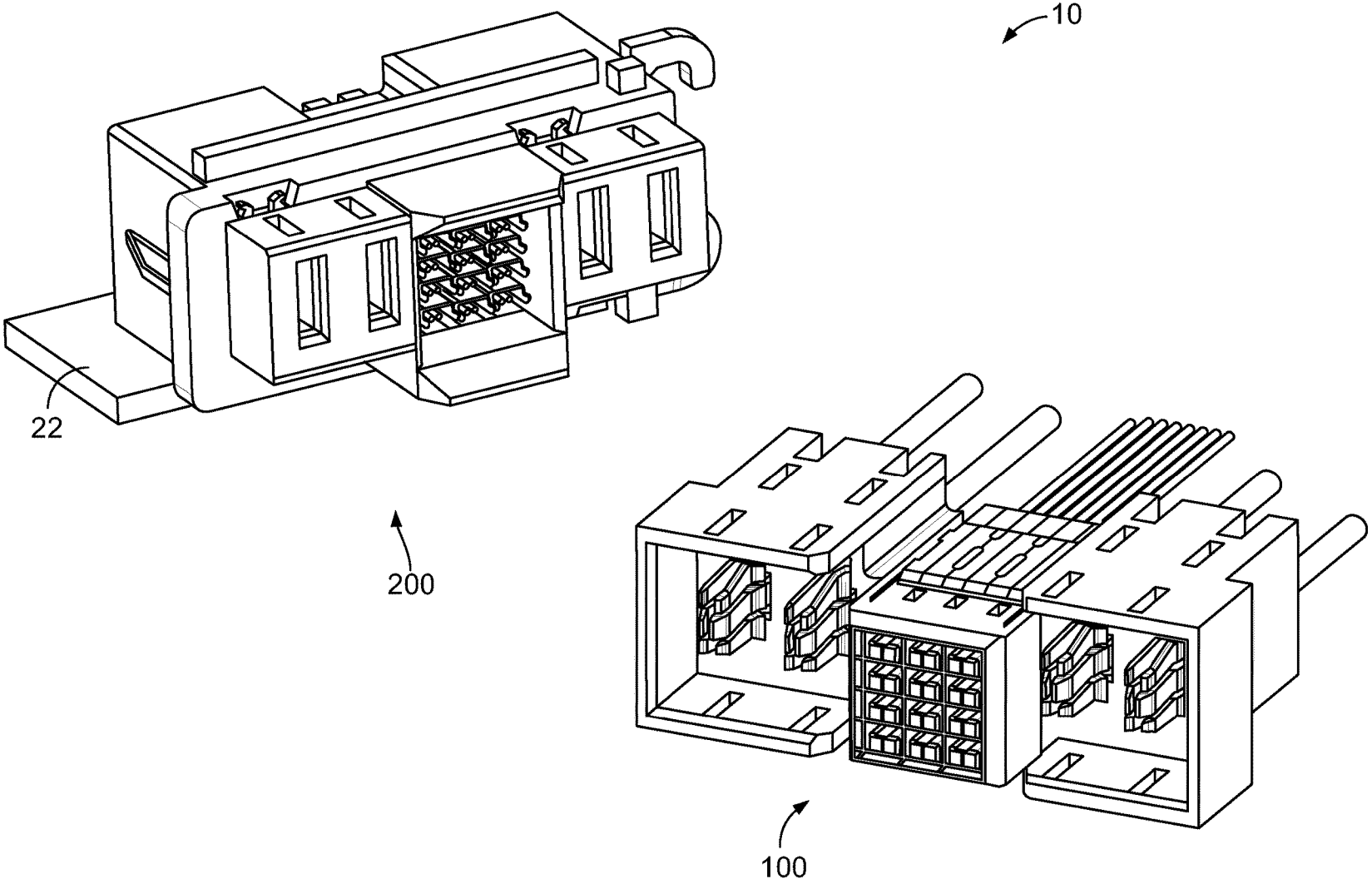
FIG. 2 illustrates the electrical connector system in accordance with an exemplary embodiment.

FIG. 2 illustrates the electrical connector system 10 in accordance with an exemplary embodiment. In the illustrated embodiment, the first hybrid electrical connector 100 is a cable connector terminated to corresponding cables, such as power cables and data cables. In the illustrated embodiment, the second hybrid electrical connector 200 is a board mounted connector mounted to a circuit board 22.

Figure 3:
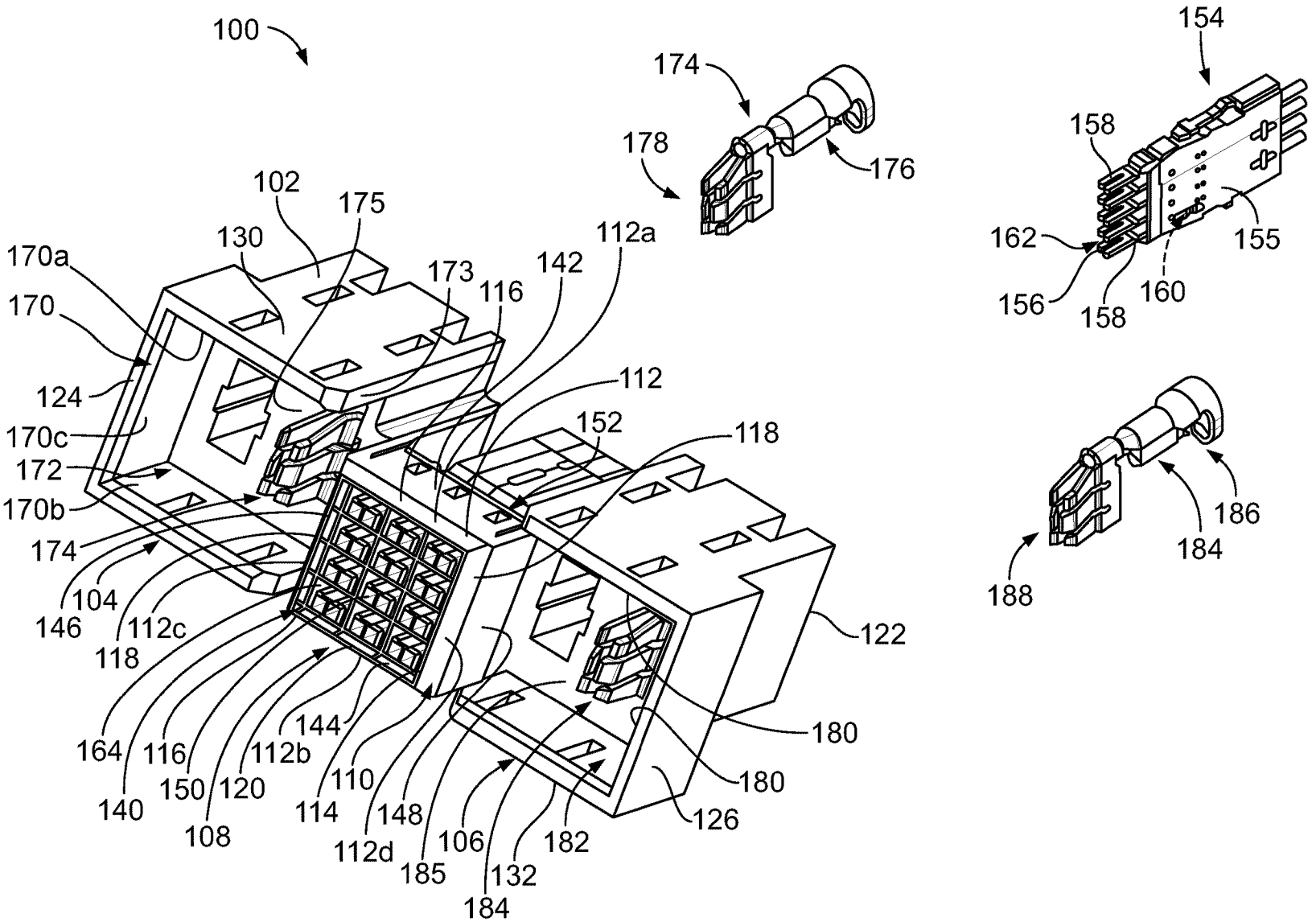
FIG. 3 is an exploded view of the first hybrid electrical connector in accordance with an exemplary embodiment.

FIG. 3 is an exploded view of the first hybrid electrical connector 100 in accordance with an exemplary embodiment. The hybrid electrical connector 100 includes a first housing 102 holding power contacts and signal contacts forming a first positive power module 104, a first negative power module 106 and a first signal module 108 between the first positive power module 104 and the first negative power module 106. The hybrid electrical connector 100 includes a first guide module 110 used to guide mating with the second hybrid electrical connector 200 (shown in FIG. 1). The power modules 104, 106, the signal module 108, and the guide module 110 are integrated as a single unit with the housing 102. In other various embodiments, rather than having positive and negative power modules, both sides of the hybrid electrical connectors 100, 200 may be positive power modules or both sides of the hybrid electrical connectors 100, 200 may be negative power modules; however, the description herein is in reference to the hybrid electrical connectors 100, 200 having both positive and negative power modules.

The housing 102 extends between a front 120 and a rear 122. The housing 102 has a first side 124 and a second side 126 opposite the first side 124. The housing 102 includes a top 130 and a bottom 132 opposite the top 130. The positive power module 104 is provided at the first side 124. The negative power module 106 is provided at the second side 126. The signal module 108 is located between the positive power module 104 and the negative power module 106, such as approximately centered between the first side 124 and the second side 126.

In an exemplary embodiment, the housing 102 includes a header block 140 at the signal module 108. The header block 140 includes an upper wall 142 and a lower wall 144. The header block 140 includes a first side wall 146 and a second side wall 148. In the illustrated embodiment, the header block 140 is rectangular shaped; however, the header block 140 may have other shapes in alternative embodiments. The header block 140 includes contact channels 150 extending therethrough. The contact channels 150 are open at the front 120 of the housing 102 and extend to a rear cavity 152 behind the header block 140.

In an exemplary embodiment, the signal module 108 includes a plurality of contact modules 154 arranged in a contact module stack. One of the contact modules 154 is illustrated poised for loading into the housing 102. The contact modules 154 are received in the rear cavity 152. The contact modules 154 are coupled to the housing 102 at the header block 140. Each contact module 154 includes a dielectric frame 155 holding signal contacts 156 and ground shields 158. Optionally, the signal contacts 156 may be arranged in pairs. The ground shields 158 provide electrical shielding for the signal contacts 156. In an exemplary embodiment, the ground shields 158 are spring beams providing shielding between the pairs of signal contacts 156 and along sides of the signal contacts 156. However, other types of ground shields may have other shapes in alternative embodiments. Each signal contact 156 extends between a terminating end 160 and a mating end 162. The mating end 162 is configured to be mated to the second hybrid electrical connector 200. The terminating end 160 is configured to be terminated to the circuit board 20 (shown in FIG. 1) or cables extending from the dielectric frame 155. In various embodiments, the terminating ends 160 are compliant pins configured to be press-fit into the circuit board 20. In other various embodiments, the terminating ends 160 are solder tails configured to be soldered to the circuit board 20. In other various embodiments, the terminating ends 160 are solder pads configured to be soldered to corresponding wires of the cables. In other various embodiments, the terminating ends 160 are crimp barrels configured to be crimped to ends of wires of the cables. Other types of terminating ends may be provided in alternative embodiments. In an exemplary embodiment, the mating ends 162 are pins. In other various embodiments, the mating ends 162 are sockets. In other various embodiments, the mating ends 162 are spring beams. Other types of mating ends may be provided in alternative embodiments. The mating ends 162 of the signal contacts 156 are received in corresponding contact channels 150. The ground shields 158 may be received in corresponding shield channels 164 in the header block 140.

In an exemplary embodiment, the guide module 110 is located between the positive power module 104 and the negative power module 106. For example, the guide module 110 is provided by the signal module 108. For example, features of the signal module 108 form guide surfaces 112 defining the guide module 110. The guide surfaces 112 are used to guide mating of the first hybrid electrical connector 100 with the second hybrid electrical connector 200. The guide surfaces 112 form a catch window for blind mating of the hybrid electrical connectors 100, 200. The guide surfaces 112 are angled to guide mating with the second hybrid electrical connector 200. In an exemplary embodiment, the guide surfaces 112 guide mating in more than one mating direction. For example, the guide surfaces 112 may guide mating in a vertical mating direction and in a horizontal mating direction. The guide surfaces 112 are located between the positive and negative power modules 104, 106 so as to not increase an overall width of the hybrid electrical connector 100 (for example, compared to a connector having guide modules and guide surfaces flanking the positive and negative power modules on the exterior sides of the positive and negative power modules).

In an exemplary embodiment, the guide surfaces 112 of the guide module 110 are provided at the header block 140. For example, the guide surfaces 112 are provided at the front 120 of the housing 102 along the header block 140. The guide surfaces 112 are provided on the upper wall 142 and/or the lower wall 144 for vertical positioning of the first hybrid electrical connector 100 with the second hybrid electrical connector 200. For example, the guide surface 112 at the upper wall 142 is an upper guide surface 112*a* and the guide surface 112 at the lower wall 144 is a lower guide surface 112*b*. In an exemplary embodiment, the upper guide surface 112*a* and the lower guide surface 112*b* form primary guide surfaces 116 used to guide mating of the first hybrid electrical connector 100 and the second hybrid electrical connector 200 in a primary direction (for example, in a vertical direction). In an exemplary embodiment, the guide surfaces 112 are beveled surfaces angled outward. The guide surfaces 112 are provided on the first side wall 146 and the second side wall 148 for horizontal positioning of the first hybrid electrical connector 100 with the second hybrid electrical connector 200. For example, the guide surface 112 at the first side wall 146 is a first edge guide surface 112*c* and the guide surface 112 at the second side wall 148 is a second edge guide surface 112*d*. In an exemplary embodiment, the first edge guide surface 112*c* and the second edge guide surface 112*d* form secondary guide surfaces 118 used to guide mating of the first hybrid electrical connector 100 and a second hybrid electrical connector 200 in a secondary direction (for example, in a horizontal direction) perpendicular to the primary direction. In an exemplary embodiment, the guide surfaces 112 include ramp surfaces 114 being angled relative to the walls of the header block 140. The guide surfaces 112 provide course alignment of the first hybrid electrical connector 100 and the second hybrid electrical connector 200. In an exemplary embodiment, the upper wall 142, the lower wall 144, the first side wall 146, and the second side wall 148 provide fine alignment of the first hybrid electrical connector 100 and the second hybrid electrical connector 200.

In an exemplary embodiment, the housing 102 includes shroud walls 170 forming a chamber 172 at the positive power module 104. For example, the shroud walls 170 include upper shroud walls 170*a*, lower shroud walls 170*b* and an end shroud wall 170*c* extending between the upper and lower shroud walls 170*a*, 170*b*. The chamber 172 is open at the front 120. The shroud walls 170 in the chamber 172 are located proximate to the first side 124 of the housing 102. The chamber 172 is defined between the first side wall 146 of the header block 140 and the first side 124 of the housing 102. In an exemplary embodiment, the upper and lower shroud walls 170 have side edges 173 facing the signal module 108. The side edges 173 are spaced apart from the first side wall 146 to form a slot configured to receive a portion of the second hybrid electrical connector 200.

The positive power module 104 includes positive power contacts 174 configured to be coupled to the housing 102. FIG. 3 illustrates one of the positive power contacts 174 loaded in the housing 102 and another positive power contact 174 poised for loading into the housing 102. The positive power module 104 may include greater or fewer positive power contacts 174 in alternative embodiments. The positive power contacts 174 extend through a base wall 175 at the rear of the chamber 172. The positive power contacts 174 are held in the housing 102 at the base wall 175.

In an exemplary embodiment, each positive power contact 174 extends between a terminating end 176 and a mating end 178. The mating end 178 extends into the chamber 172. The mating end 178 is configured to be mated to the second hybrid electrical connector 200. The terminating end 176 is configured to be terminated to the circuit board 20 (shown in FIG. 1) or power cables. In various embodiments, the terminating ends 176 include compliant pins configured to be press-fit into the circuit board 20. In other various embodiments, the terminating ends 176 include tails configured to be soldered or welded to the circuit board 20. In other various embodiments, the terminating ends 176 are pads configured to be soldered or welded to the power cables. In other various embodiments, the terminating ends 176 are crimp barrels configured to be crimped to ends of the cables. Other types of terminating ends may be provided in alternative embodiments. In an exemplary embodiment, the mating ends 178 include spring beams, such as two rows of spring beams. In other various embodiments, the mating ends 178 are blades. In other various embodiments, the mating ends 178 may be pins or sockets. Other types of mating ends may be provided in alternative embodiments.

In an exemplary embodiment, the housing 102 includes shroud walls 180 forming a chamber 182 at the negative power module 106. The chamber 182 is open at the front 120. The shroud walls 180 in the chamber 182 are located proximate to the second side 126 of the housing 102. The chamber 182 is defined between the second side wall 148 of the header block 140 and the first side 124 of the housing 102.

The negative power module 106 includes negative power contacts 184 configured to be coupled to the housing 102. FIG. 3 illustrates one of the negative power contacts 184 loaded in the housing 102 and another negative power contact 140 poised for loading into the housing 102. The negative power module 106 may include greater or fewer negative power contacts 184 in alternative embodiments. The negative power contacts 184 extend through a base wall 185 at the rear of the chamber 182. The negative power contacts 184 are held in the housing 102 at the base wall 185.

In an exemplary embodiment, each negative power contact 184 extends between a terminating end 186 and a mating end 188. The mating end 188 extends into the chamber 182. The mating end 188 is configured to be mated to the second hybrid electrical connector 200. The terminating end 186 is configured to be terminated to the circuit board 20 (shown in FIG. 1) or power cables. In various embodiments, the terminating ends 186 include compliant pins configured to be press-fit into the circuit board 20. In other various embodiments, the terminating ends 186 include tails configured to be soldered or welded to the circuit board 20. In other various embodiments, the terminating ends 186 are pads configured to be soldered or welded to the power cables. In other various embodiments, the terminating ends 186 are crimp barrels configured to be crimped to ends of the cables. Other types of terminating ends may be provided in alternative embodiments. In an exemplary embodiment, the mating ends 188 include spring beams, such as two rows of spring beams. In other various embodiments, the mating ends 188 are blades. In other various embodiments, the mating ends 188 may be pins or sockets. Other types of mating ends may be provided in alternative embodiments.

The signal module 108 is located between the positive and negative power modules 104, 106 to isolate the positive power contacts 174 from the negative power contacts 184. The header block 140 electrically isolates the positive power contacts 174 from the negative power contacts 184, such as preventing arcing or electrical creeping. The header block 140 prevents short circuiting of the positive and negative power contacts 174, 184 by physically separating the positive and negative power contacts 174, 184.

The guide module 110 is located between the positive and negative power modules 104, 106, such as between the positive power contacts 174 and the negative power contacts 184. The guide surfaces 112 are used to guide mating of the first hybrid electrical connector 100 with the second hybrid electrical connector 200. The guide surfaces 112 align the positive power module 104 with the second hybrid electrical connector 200 prior to the positive power contacts 174 being mated to corresponding positive power contacts of the second hybrid electrical connector 200. The guide surfaces 112 align the negative power module 106 with the second hybrid electrical connector 200 prior to the negative power contacts 184 being mated to corresponding negative power contacts of the second hybrid electrical connector 200. The guide surfaces 112 align the signal module 108 with the second hybrid electrical connector 200 prior to the signal contacts 156 being mated to corresponding signal contacts of the second hybrid electrical connector 200.

Figure 4:
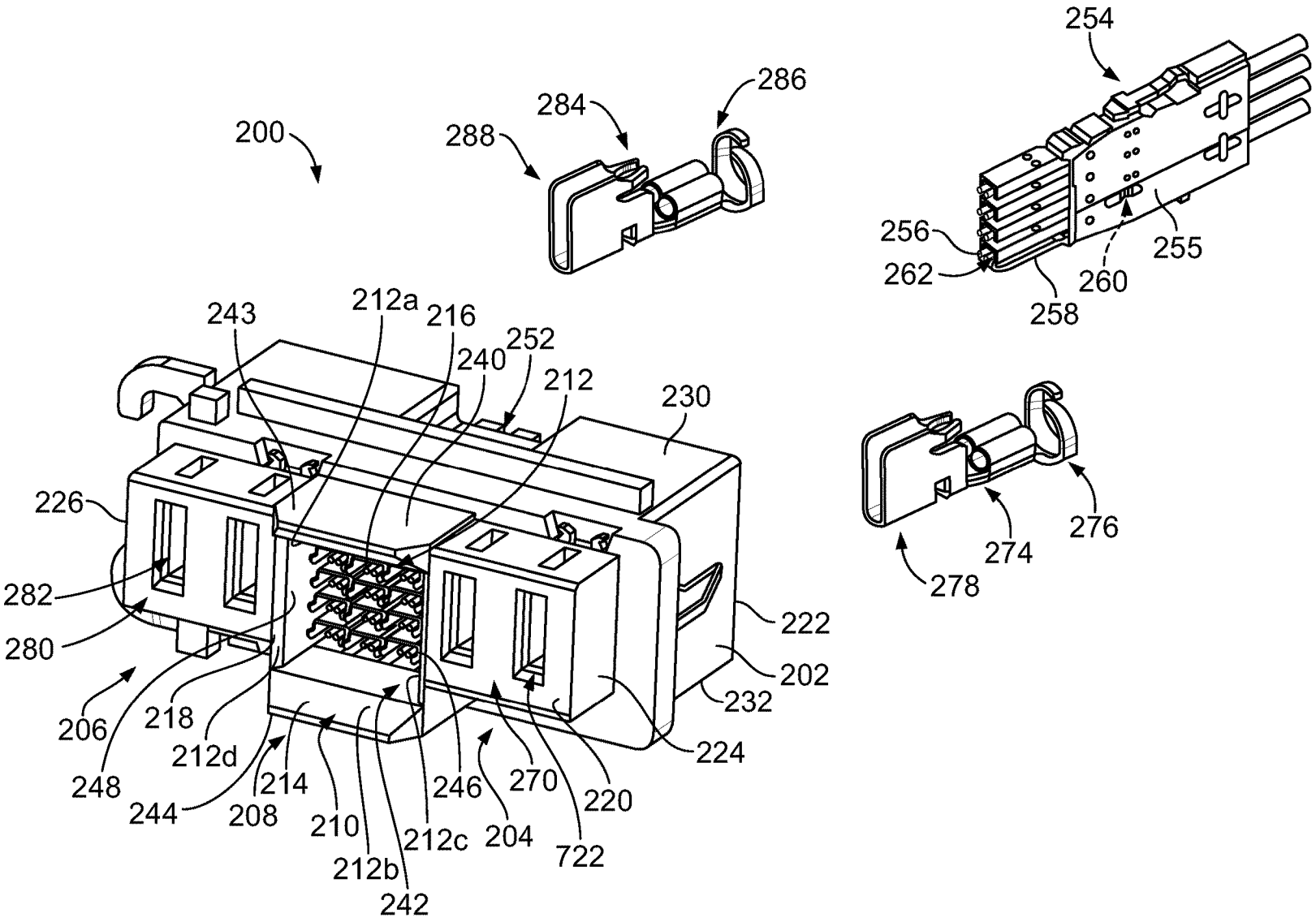
FIG. 4 is an exploded view of the second hybrid electrical connector in accordance with an exemplary embodiment.

FIG. 4 is an exploded view of the second hybrid electrical connector 200 in accordance with an exemplary embodiment. The hybrid electrical connector 200 includes a second housing 202 holding power contacts and signal contacts forming a second positive power module 204, a second negative power module 206 and a second signal module 208 between the second positive power module 204 and the second negative power module 206. The hybrid electrical connector 200 includes a second guide module 210 used to guide mating with the first hybrid electrical connector 100 (shown in FIG. 1). The power modules 204, 206, the signal module 208, and the guide module 210 are integrated as a single unit with the housing 202.

The housing 202 extends between a front 220 and a rear 222. The housing 202 has a first side 224 and a second side 226 opposite the first side 224. The housing 202 includes a top 230 and a bottom 232 opposite the top 230. The positive power module 204 is provided at the first side 224. The negative power module 206 is provided at the second side 226. The signal module 208 is located between the positive power module 204 and the negative power module 206, such as approximately centered between the first side 224 and the second side 226.

In an exemplary embodiment, the housing 202 includes shroud walls 240 forming a chamber 242 at the signal module 208. The shroud walls 240 include an upper shroud wall 243 and a lower shroud wall 244. The shroud walls 240 include a first side wall 246 and a second side wall 248. In the illustrated embodiment, the chamber 242 is rectangular shaped; however, the chamber 242 may have other shapes in alternative embodiments. The chamber 242 is sized and shaped to receive the header block 140 (shown in FIG. 3). In an exemplary embodiment, the housing 202 includes a rear cavity 252 behind the chamber 242.

In an exemplary embodiment, the signal module 208 includes a plurality of contact modules 254 arranged in a contact module stack. One of the contact modules 254 is illustrated poised for loading into the housing 202. The contact modules 254 are received in the rear cavity 252. The contact modules 254 are coupled to the rear 222 of the housing 202. Each contact module 254 includes a dielectric frame 255 holding signal contacts 256 and ground shields 258. The ground shields 258 provide electrical shielding for the signal contacts 256. In an exemplary embodiment, the ground shields 258 are C-shaped providing shielding on three sides of the signal contacts 256. However, the ground shields 258 may have other shapes in alternative embodiments. Optionally, the signal contacts 256 may be arranged in pairs. Each signal contact 256 extends between a terminating end 260 and a mating end 262. The mating end 262 is configured to be mated to the first hybrid electrical connector 100. The terminating end 260 is configured to be terminated to the circuit board 20 (shown in FIG. 2) or cables extending from the dielectric frame 255. In various embodiments, the terminating ends 260 are compliant pins configured to be press-fit into the circuit board 20. In other various embodiments, the terminating ends 260 are solder tails configured to be soldered to the circuit board 20. In other various embodiments, the terminating ends 260 are solder pads configured to be soldered to corresponding wires of the cables. In other various embodiments, the terminating ends 260 are crimp barrels configured to be crimped to ends of wires of the cables. Other types of terminating ends may be provided in alternative embodiments. In an exemplary embodiment, the mating ends 262 are pins. In other various embodiments, the mating ends 262 are sockets. In other various embodiments, the mating ends 262 are spring beams. Other types of mating ends may be provided in alternative embodiments. The mating ends 262 of the signal contacts 256 are configured to be received in corresponding contact channels 150 of the header block 140 (both shown in FIG. 3) for mating with the signal contacts 156 (shown in FIG. 3). The ground shields 258 may be received in corresponding shield channels 164 (shown in FIG. 3) in the header block 140 for mating with the ground shields 158 (shown in FIG. 3).

In an exemplary embodiment, the guide module 210 is located between the positive power module 204 and the negative power module 206. For example, the guide module 210 is provided by the signal module 208. For example, the shroud walls 240 of the signal module 208 form guide surfaces 212 defining the guide module 210. In an exemplary embodiment, the shroud walls 240 extend forward of other portions of the housing 202, such as forward of the positive and negative power modules 204, 206. The guide surfaces 212 are used to guide mating of the second hybrid electrical connector 200 with the first hybrid electrical connector 100. The guide surfaces 212 form a catch window for blind mating of the hybrid electrical connectors 100, 200. The guide surfaces 212 are beveled and angled inward toward the chamber 242 to guide mating with the first hybrid electrical connector 100. In an exemplary embodiment, the guide surfaces 212 guide mating in more than one mating direction. For example, the guide surfaces 212 may guide mating in a vertical mating direction and in a horizontal mating direction. The guide surfaces 212 are located between the positive and negative power modules 204, 206 so as to not increase an overall width of the hybrid electrical connector 200 (for example, compared to a connector having guide modules and guide surfaces flanking the positive and negative power modules on the exterior sides of the positive and negative power modules).

In an exemplary embodiment, the guide surfaces 212 are provided on the upper shroud wall 243 and/or the lower shroud wall 244 for vertical positioning of the second hybrid electrical connector 200 with the first hybrid electrical connector 100. For example, the guide surface 212 at the upper shroud wall 243 is an upper guide surface 212*a* and the guide surface 212 at the lower shroud wall 244 is a lower guide surface 212*b*. In an exemplary embodiment, the upper guide surface 212*a* and the lower guide surface 212*b* form primary guide surfaces 216 used to guide mating of the second hybrid electrical connector 200 and the first hybrid electrical connector 100 in a primary direction (for example, in a vertical direction). The guide surfaces 212 are provided on the first side wall 246 and the second side wall 248 for horizontal positioning of the second hybrid electrical connector 200 with the first hybrid electrical connector 100. For example, the guide surface 212 at the second side wall 246 is a first edge guide surface 212*c* and the guide surface 212 at the second side wall 248 is a second edge guide surface 212*d*. In an exemplary embodiment, the first edge guide surface 212*c* and the second edge guide surface 212*d* form secondary guide surfaces 218 used to guide mating of the second hybrid electrical connector 200 and a first hybrid electrical connector 100 in a secondary direction (for example, in a horizontal direction) perpendicular to the primary direction. Optionally, the upper guide surface 212*a* and the lower guide surface 212*b* extend forward of the first side wall 246 and the second side wall 248. The upper guide surface 212*a* and the lower guide surface 212*b* may extend forward of the first edge guide surface 212*c* and the second edge guide surface 212*d*. In an exemplary embodiment, the guide surfaces 212 include ramp surfaces 214 being angled relative to the shroud walls 240. The guide surfaces 212 provide course alignment of the second hybrid electrical connector 200 and the first hybrid electrical connector 100. The guide surfaces 212 interface with the guide surfaces 112 of the first hybrid electric connector 100.

In an exemplary embodiment, the housing 202 includes a header block 270 at the positive power module 204. The header block 270 includes contact channels 272. The positive power module 204 includes positive power contacts 274 configured to be coupled to the housing 202. FIG. 4 illustrates one of the positive power contacts 274 loaded in the housing 202 and another positive power contact 274 poised for loading into the housing 202. The positive power module 204 may include greater or fewer positive power contacts 274 in alternative embodiments. The positive power contacts 274 are loaded into the rear 222 of the housing 202 into the corresponding contact channels 272. The contact channels 272 are configured to receive the positive power contacts 174 (shown in FIG. 3) of the first hybrid electrical connector 100.

In an exemplary embodiment, each positive power contact 274 extends between a terminating end 276 and a mating end 278. The mating end 278 is configured to be mated to the mating end 178 of the first positive power contact 174. The terminating end 276 is configured to be terminated to power cables or the circuit board 22 (shown in FIG. 1).

In an exemplary embodiment, the housing 202 includes a header block 280 at the negative power module 206. The header block 280 includes contact channels 282. The negative power module 206 includes negative power contacts 284 configured to be coupled to the housing 202 and received in the contact channels 282. FIG. 4 illustrates one of the negative power contacts 284 loaded in the housing 202 and another negative power contact 284 poised for loading into the housing 202. The negative power module 206 may include greater or fewer negative power contacts 284 in alternative embodiments.

In an exemplary embodiment, each negative power contact 284 extends between a terminating end 286 and a mating end 288. The mating end 288 is configured to be mated to the mating end 188 of the first negative power contact 184 (both shown in FIG. 3). The terminating end 286 is configured to be terminated to the power cables or the circuit board 22.

The signal module 208 is located between the positive and negative power modules 204, 206 to isolate the positive power contacts 274 from the negative power contacts 284. The side walls 246, 248 electrically isolates the positive power contacts 274 from the negative power contacts 284, such as preventing arcing or electrical creeping. The signal module 208 prevents short circuiting of the positive and negative power contacts 274, 284 by physically separating the positive and negative power contacts 274, 284.

The guide module 210 is located between the positive and negative power modules 204, 206, such as between the positive power contacts 274 and the negative power contacts 284. The guide surfaces 212 are used to guide mating of the second hybrid electrical connector 200 with the first hybrid electrical connector 100. The guide surfaces 212 align the positive power module 204 with the first hybrid electrical connector 100 prior to the positive power contacts 274 being mated to corresponding positive power contacts of the first hybrid electrical connector 100. The guide surfaces 212 align the negative power module 206 with the first hybrid electrical connector 100 prior to the negative power contacts 284 being mated to corresponding negative power contacts of the first hybrid electrical connector 100. The guide surfaces 212 align the signal module 208 with the first hybrid electrical connector 100 prior to the signal contacts 256 being mated to corresponding signal contacts of the first hybrid electrical connector 100.

Figure 5:
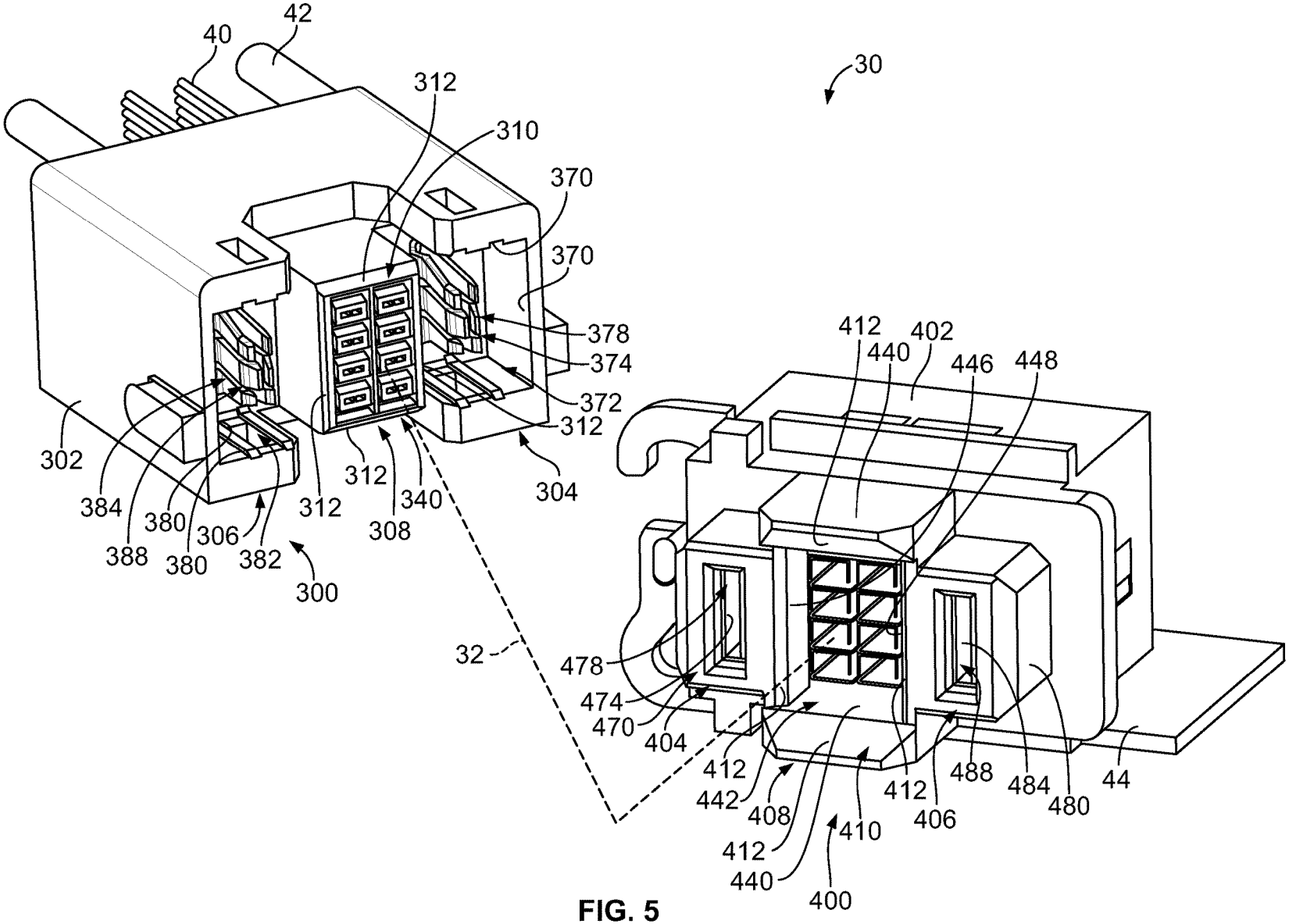
FIG. 5 illustrates an electrical connector system in accordance with an exemplary embodiment including first and second hybrid electrical connectors.

FIG. 5 illustrates an electrical connector system 30 in accordance with an exemplary embodiment. The electrical connector system 30 includes a first hybrid electrical connector 300 and a second hybrid electrical connector 400. The first hybrid electrical connector 300 is similar to the first hybrid electrical connector 100, however, the first hybrid electrical connector 300 includes fewer power contacts and signal contacts and is shaped differently than the first hybrid electrical connector 100. The second hybrid electrical connector 400 is similar to the second hybrid electrical connector 200, however, the second hybrid electrical connector 400 includes fewer power contacts and signal contacts and is shaped differently than the second hybrid electrical connector 200. The hybrid electrical connectors 300, 400 are configured to be mated along a mating axis 32. The first hybrid electrical connector 300 includes a power interface and a signal interface for transmitting power and data. The second hybrid electrical connector 400 includes a power interface and a signal interface for transmitting power and data.

In the illustrated embodiment, the first hybrid electrical connector 300 is a cable connector terminated to signal cables 40 and power cables 42. In alternative embodiments, the first hybrid electrical connector 300 may be a board mounted connector terminated to a circuit board. In the illustrated embodiment, the second hybrid electrical connector 400 is a board mounted connector terminated to a circuit board 44. However, in alternative embodiments, the second hybrid electrical connector 200 may be a cable connector terminated to cables.

The hybrid electrical connector 300 includes a first housing 302 holding power contacts and signal contacts forming a first positive power module 304, a first negative power module 306 and a first signal module 308 between the first positive power module 304 and the first negative power module 306. The hybrid electrical connector 300 includes a first guide module 310 used to guide mating with the second hybrid electrical connector 400. The power modules 304, 306, the signal module 308, and the guide module 310 are integrated as a single unit with the housing 302. In an exemplary embodiment, the housing 302 includes a header block 340 at the signal module 308. In an exemplary embodiment, the guide module 310 is located between the positive power module 304 and the negative power module 306. For example, the header block 340 forms guide surfaces 312 defining the guide module 310. The guide surfaces 312 are used to guide mating of the first hybrid electrical connector 300 with the second hybrid electrical connector 400. In an exemplary embodiment, the guide surfaces 312 guide mating in more than one mating direction. For example, the guide surfaces 312 may guide mating in a vertical mating direction and in a horizontal mating direction.

In an exemplary embodiment, the housing 302 includes shroud walls 370 forming a chamber 372 at the positive power module 304. The positive power module 304 includes positive power contacts 374 configured to be coupled to the housing 302. In an exemplary embodiment, each positive power contact 374 extends between a terminating end and a mating end 378. The mating end 378 extends into the chamber 372 for mating with the second hybrid electrical connector 400.

In an exemplary embodiment, the housing 302 includes shroud walls 380 forming a chamber 382 at the negative power module 306. The negative power module 306 includes negative power contacts 384 configured to be coupled to the housing 302. In an exemplary embodiment, each negative power contact 384 extends between a terminating end and a mating end 388. The mating end 388 extends into the chamber 382 for mating with the second hybrid electrical connector 400.

The signal module 308 is located between the positive and negative power modules 304, 306 to isolate the positive power contacts 374 from the negative power contacts 384. The header block 340 electrically isolates the positive power contacts 374 from the negative power contacts 384, such as preventing arcing or electrical creeping. The header block 340 prevents short circuiting of the positive and negative power contacts 374, 384 by physically separating the positive and negative power contacts 374, 384.

The hybrid electrical connector 400 includes a second housing 402 holding power contacts and signal contacts forming a second positive power module 404, a second negative power module 406 and a second signal module 408 between the second positive power module 404 and the second negative power module 406. The hybrid electrical connector 400 includes a second guide module 410 used to guide mating with the first hybrid electrical connector 300. The power modules 404, 406, the signal module 408, and the guide module 410 are integrated as a single unit with the housing 402. In an exemplary embodiment, the housing 402 includes shroud walls 440 forming a chamber 442 at the signal module 408. The guide module 410 is located between the positive power module 404 and the negative power module 406. The guide module 410 includes guide surfaces 412 configured to interface with the guide surfaces 312 to guide mating with the first hybrid electrical connector 300.

In an exemplary embodiment, the housing 402 includes a header block 470 at the positive power module 404. The positive power module 404 includes positive power contacts 474 configured to be coupled to the housing 402. In an exemplary embodiment, each positive power contact 474 extends between a terminating end and a mating end 478. The mating end 478 is configured to be mated to the mating end 378 of the first positive power contact 374.

In an exemplary embodiment, the housing 402 includes a header block 480 at the negative power module 406. The negative power module 406 includes negative power contacts 484 configured to be coupled to the housing 402. In an exemplary embodiment, each negative power contact 484 extends between a terminating end and a mating end 488. The mating end 488 is configured to be mated to the mating end 388 of the first negative power contact 384.

The signal module 408 is located between the positive and negative power modules 404, 406 to isolate the positive power contacts 474 from the negative power contacts 484. The side walls 446, 448 electrically isolates the positive power contacts 474 from the negative power contacts 484, such as preventing arcing or electrical creeping. The signal module 408 prevents short circuiting of the positive and negative power contacts 474, 484 by physically separating the positive and negative power contacts 474, 484.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A hybrid electrical connector comprising:

a housing extending between a front and a rear, the housing having a first side and a second side opposite the first side, the housing having a top and a bottom opposite the top, the housing having a guide module having guide surfaces for guiding mating with a mating electrical connector, the guide module being approximately centered between the first side and the second side remote from the first side and remote from the second side;

a first power module including first power contacts coupled to the housing proximate to the first side, each first power contact having a terminating end and a mating end, the mating end configured to be mated to first power contacts of the mating electrical connector;

a second power module including second power contacts coupled to the housing proximate to the second side, each second power contact having a terminating end and a mating end, the mating end configured to be mated to second power contacts of the mating electrical connector; and a signal module including signal contacts and ground shields providing electrical shielding for the signal contacts, each signal contact having a terminating end and a mating end, the mating end configured to be mated to signal contacts of the mating electrical connector, the signal module located between the first power module and the second power module.

2. The hybrid electrical connector of claim 1, wherein the guide surfaces of the guide module include a primary guide surface for guiding mating with the mating electrical connector in a primary direction and a secondary guide surface for guiding mating with the mating electrical connector in a secondary direction perpendicular to the primary direction.

3. The hybrid electrical connector of claim 1, wherein the guide surfaces of the guide module include an upper guide surface and a lower guide surface for guiding mating with the mating electrical connector in a vertical mating direction, and wherein the guide surfaces of the guide module include a first edge guide surface and a second edge guide surface for guiding mating with the mating electrical connector in a horizontal mating direction.

4. The hybrid electrical connector of claim 1, wherein the guide surfaces extend forward of the first power module and the second power module.

5. The hybrid electrical connector of claim 1, wherein the guide surfaces align the first power module with the mating electrical connector prior to the first power contacts being mated to the first power contacts of the mating electrical connector, wherein the guide surfaces align the second power module with the mating electrical connector prior to the second power contacts being mated to the second power contacts of the mating electrical connector, and wherein the guide surfaces align the signal module with the mating electrical connector prior to the signal contacts being mated to the signal contacts of the mating electrical connector.

6. The hybrid electrical connector of claim 1, wherein the guide surfaces include ramps to guide mating of the guide module with the mating electrical connector.

7. The hybrid electrical connector of claim 1, wherein the housing includes shroud walls forming a chamber at the signal module, the signal contacts and the ground shields extending into the chamber, the guide surfaces extending from the shroud walls to guide the mating electrical connector into the chamber.

8. The hybrid electrical connector of claim 1, wherein the housing includes a header block at the signal module, the header block including contact channels holding the signal contacts, the guide surfaces extending forward of the header block to guide the header block into the mating electrical connector during mating.

9. The hybrid electrical connector of claim 1, wherein the signal module includes a first side wall and a second side wall, the first side wall located between the signal module and the first power module, the second side wall located between the signal module and the second power module.

10. The hybrid electrical connector of claim 1, wherein the housing includes first shroud walls forming a first chamber at the first power module, the first power contacts extending into the first chamber, the housing including second shroud walls forming a second chamber at the second power module, the second power contacts extending into the second chamber, the guide surfaces extending forward of the first shroud walls and the second shroud walls to align the mating electrical connector with the first and second chambers to guide the mating electrical connector into the first and second chambers.

11. The hybrid electrical connector of claim 1, wherein the housing includes a rear cavity at the signal module, the signal module including contact modules loaded into the rear cavity.

12. The hybrid electrical connector of claim 1, wherein the first power contacts are positive power contacts and the second power contacts are negative power contacts, all of the signal contacts being located between the positive power contacts and the negative power contacts.

13. A hybrid electrical connector comprising:

a housing extending between a front and a rear, the housing having a top and a bottom opposite the top, the housing having a first side and a second side opposite the first side, the housing including a first connector at the first side, a second connector at the second side, and a center connector between the first connector and the second connector, the center connector including a guide module having a primary guide surface for guiding mating with a mating electrical connector in a primary direction and a secondary guide surface for guiding mating with the mating electrical connector in a secondary direction perpendicular to the primary direction;

a positive power module at the first connector, the positive power module including positive power contacts coupled to the housing proximate to the first side, each positive power contact having a terminating end and a mating end, the mating end configured to be mated to positive power contacts of the mating electrical connector;

a negative power module at the second connector, the negative power module including negative power contacts coupled to the housing proximate to the second side, each negative power contact having a terminating end and a mating end, the mating end configured to be mated to negative power contacts of the mating electrical connector; and a signal module at the center connector, the signal module including signal contacts and ground shields providing electrical shielding for the signal contacts, each signal contact having a terminating end and a mating end, the mating end configured to be mated to signal contacts of the mating electrical connector, the signal module located between the positive power module and the negative power module.

14. The hybrid electrical connector of claim 13, wherein at least one of the primary guide surface and the secondary guide surface extends forward of the positive power module and the negative power module.

15. The hybrid electrical connector of claim 13, wherein the primary and secondary guide surfaces align the positive power module with the mating electrical connector prior to the positive power contacts being mated to the positive power contacts of the mating electrical connector, wherein the guide surfaces align the negative power module with the mating electrical connector prior to the negative power contacts being mated to the negative power contacts of the mating electrical connector, and wherein the guide surfaces align the signal module with the mating electrical connector prior to the signal contacts being mated to the signal contacts of the mating electrical connector.

16. The hybrid electrical connector of claim 13, wherein the primary and secondary guide surfaces include ramps to guide mating of the guide module with the mating electrical connector.

17. The hybrid electrical connector of claim 13, wherein the signal module includes a first side wall and a second side wall, the first side wall located between the signal module and the positive power module, the second side wall located between the signal module and the negative power module.

18. An electrical connector system comprising:

a first hybrid electrical connector including a first housing, a first positive power module, a first negative power module and a first signal module between the first positive power module and the first negative power module, the first housing extending between a front and a rear, the first housing having opposite first and second sides, the first positive power module including first positive power contacts coupled to the first housing proximate to the first side of the first housing, the first negative power module including first negative power contacts coupled to the first housing proximate to the second side of the first housing, the first signal module including first signal contacts and first ground shields providing electrical shielding for the first signal contacts, the first signal module including a first guide module having first guide surfaces, the first guide module being located between the first positive power module and the first negative power module;

a second hybrid electrical connector mated to the first hybrid electrical connector, the second hybrid electrical connector including a second housing, a second positive power module, a second negative power module and a second signal module between the second positive power module and the second negative power module, the second housing extending between a front and a rear, the second housing having opposite first and second sides, the second positive power module including second positive power contacts coupled to the second housing proximate to the first side of the second housing, the second positive power contacts being mated to first positive power contacts, the second negative power module including second negative power contacts coupled to the second housing proximate to the second side of the second housing, the second negative power contacts being mated to the first negative power contacts, the second signal module including second signal contacts and second ground shields providing electrical shielding for the second signal contacts, the second signal contact being mated to the first signal contact and the second ground shields being mated to the first ground shields, the second signal module including a second guide module having second guide surfaces, the second guide module being located between the second positive power module and the second negative power module;

wherein the second guide surfaces interface with the first guide surfaces of the first guide module to align the second signal module with the first signal module prior to mating the second signal contact and the first signal contact;

wherein the second guide surfaces interface with the first guide surfaces of the first guide module to align the second positive power module with the first positive power module prior to mating the second positive power contact and the first positive power contact; and wherein the second guide surfaces interface with the first guide surfaces of the first guide module to align the second negative power module with the first negative power module prior to mating the second negative power contact and the first negative power contact.

19. The electrical connector system of claim 18, wherein the first housing includes a header block at the first signal module, the header block including contact channels holding the first signal contacts, the first guide surfaces including an upper guide surface at a top of the header block and a lower guide surface at a bottom of the header block, and the first guide surfaces include a first edge guide surface at a first side of the header block and a second edge guide surface at a second side of the header block; and wherein the second housing includes shroud walls forming a chamber at the second signal module, the second signal contacts and the second ground shields extending into the chamber, the second guide surfaces extending from the shroud walls to interface with the upper and lower guide surfaces to guide the header block into the chamber, the first and second edge guide surface engaging the shroud walls to guide the header block into the chamber.

20. The electrical connector system of claim 18, wherein the guide surfaces include ramps to guide mating of the guide module with the mating electrical connector.

* * * * *